United States Patent [19]

McQueen et al.

[11] 4,448,232

[45] May 15, 1984

[54] BI-FOLD DOOR ASSEMBLY

[75] Inventors: Coy E. McQueen; Lynn O. Twedt, both of Harvard, Ill.

[73] Assignee: Erect-A-Tube, Inc., Harvard, Ill.

[21] Appl. No.: 374,178

[22] Filed: May 3, 1982

[51] Int. Cl.[3] ..... E05D 15/26

[52] U.S. Cl. ..... 160/207; 136/291

[58] Field of Search ..... 160/207, 209, 189, 229; 16/366; 136/291

[56] References Cited

U.S. PATENT DOCUMENTS

| | | | |
|---|---|---|---|
| 1,782,203 | 11/1930 | Hanley | 160/229 X |
| 2,041,410 | 5/1936 | Goodman | 160/207 |
| 2,155,116 | 4/1939 | Cox | 160/207 |
| 2,327,316 | 8/1943 | Michelman | 160/189 |
| 2,681,699 | 6/1954 | Lissaman | 160/209 X |
| 3,155,147 | 11/1964 | Smith | 160/207 X |
| 3,648,755 | 3/1972 | Thiele | 160/201 |
| 4,026,267 | 5/1977 | Coleman | 126/436 |
| 4,261,409 | 4/1981 | De Vore | 160/207 |

*Primary Examiner*—Peter M. Caun
*Assistant Examiner*—Cherney S. Lieberman
*Attorney, Agent, or Firm*—Arnstein, Gluck, Lehr, Barron & Milligan

[57] ABSTRACT

A bi-fold door assembly for a building. The door assembly includes an upper door section and a lower door section hinged to one another together with a door track mounted in an upwardly and inwardly inclined position. Additionally, the bottom of the lower door section cooperates with the door track for guided raising and lowering movement of the bi-fold door. The door assembly may also include an automatic opener operatively associated with the upper and lower door sections. When provided, the automatic opener may include a battery powered electrical motor together with a battery operatively associated with a solar panel for recharging thereof.

12 Claims, 10 Drawing Figures

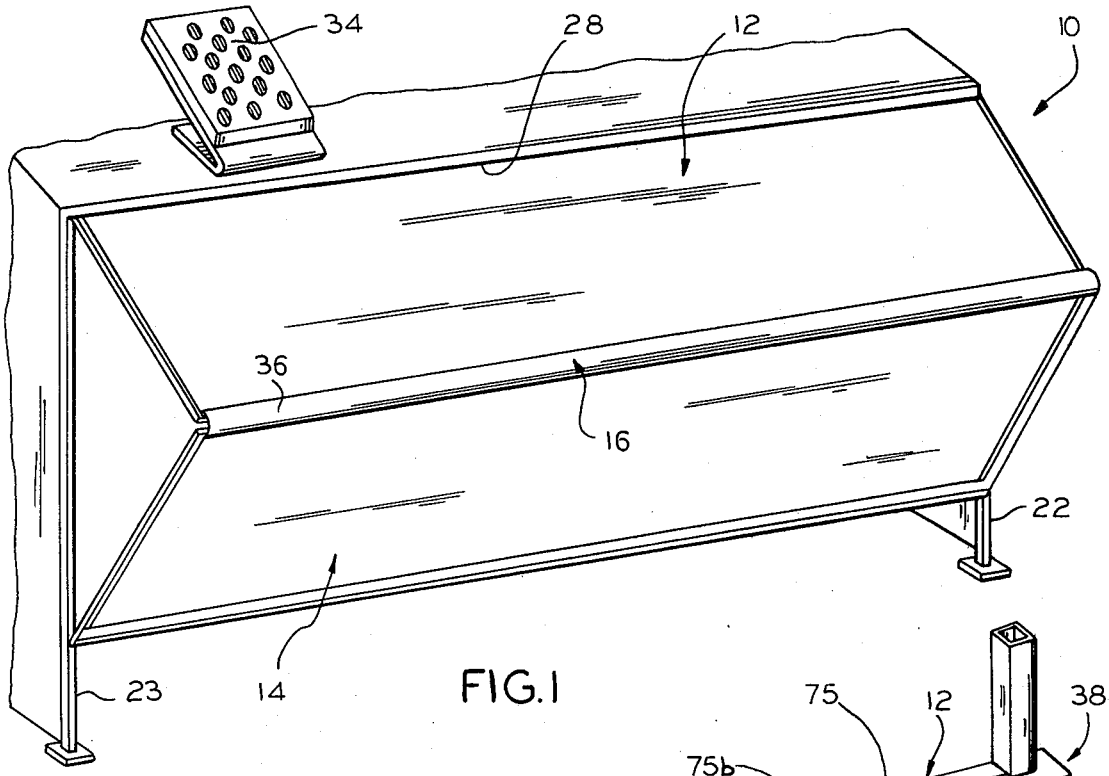
FIG.1
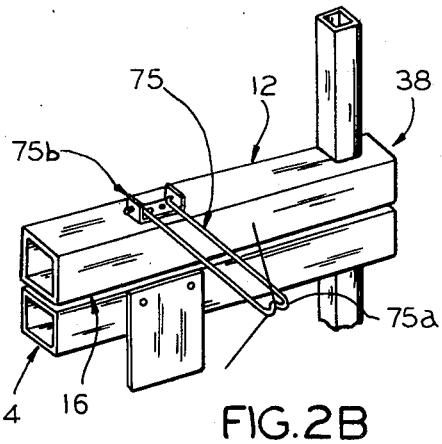
FIG.2B
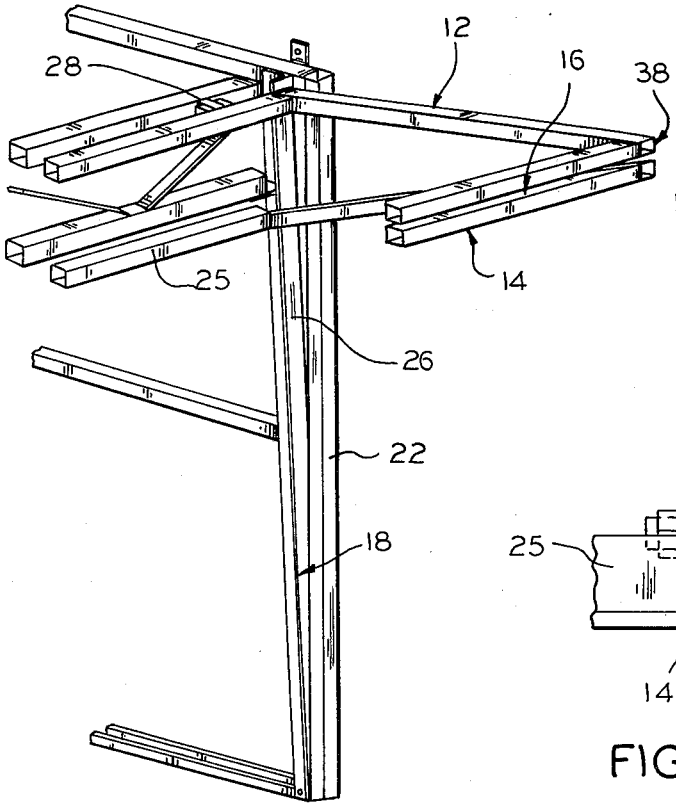
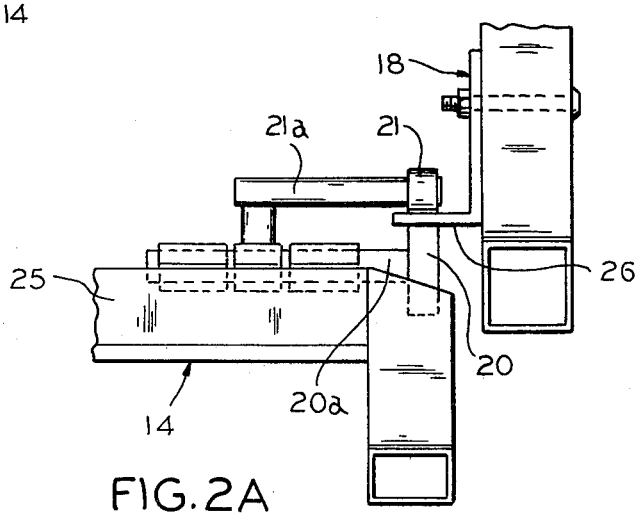
FIG.2A
FIG.2

BI-FOLD DOOR ASSEMBLY

BACKGROUND OF THE INVENTION

The present invention relates to doors and, more particularly, to an improved bi-fold door assembly.

In recent years, the use of out buildings for storage has expanded to a very significant degree. Such buildings have found use, for instance, as hangers to accommodate the considerable expansion in the use of small aircraft for both business and pleasure with the resulting problem of providing adequate shelter at a reasonable price and for storage of large equipment such as farm machinery, earth moving equipment, large trucks and the like. As a result, the need for large doors for such buildings which operate safely, effectively and efficiently has been the focus of those in this field.

Some years ago, Erect-A-Tube, Inc., our assignee, pioneered the development of a unique bi-fold door. These doors, which are quite large in size ranging to at least 80 feet wide by 20 feet high, have become a standard. It is now recognized that the bi-fold door gives rugged, dependable service and is reliable and easy working even in ice and snow. These doors, which are easy to install on post-frame or steel buildings, can be sheeted and insulated with conventional building materials. As such, the bi-fold doors give extra clearance for large openings and are compatible with all metal building systems.

In the past, bi-fold doors have been adapted to cooperate with vertical door tracks. The door, which includes two parallel door sections which are horizontally hinged, includes means on the bottom of the lower door portions to cooperate with the vertical door track. As a result, the bottom of the door moves straight up from the floor so that snow and ice cannot restrict the opening action in any way thereby reducing the need for snow removal while eliminating frozen door problems.

Despite the numerous significant advantages to a bi-fold door, several problems have remained unresolved. The principal problem has been the difficulty in assuring that the door fully closes when it is lowered so as to provide the requisite security and to fully protect the contents of the building from weather conditions. Because of the vertical door tracks, and the uniqueness of the configuration of the door, the bi-fold door can have a tendency to stick in a partially opened condition.

Another problem with bi-fold doors has been the difficulty in supplying electrical power for automatic openers. This is particularly true for applications such as aircraft hangars located in remote regions or other buildings provided for the storage of construction equipment or other large equipment in areas where there is limited access and difficulty in supplying electrical power. Accordingly, since bi-fold doors are by nature quite heavy, it has been difficult to utilize their many advantages in buildings located in remote regions.

It is therefore an object of the present invention to provide a bi-fold door assembly which takes full advantage of the many features inherent in prior bi-fold door constructions while overcoming the few remaining obstacles to perfecting the design, construction and operation of such doors.

These and other objects, features and advantages of the present invention will become apparent from the following description when considered in connection with the accompanying drawings.

SUMMARY OF THE INVENTION

In general, the objects and advantages of the present invention are met by providing a bi-fold door assembly for a building having a unique combination of features and components. The assembly includes an upper door section and a lower door section hinged to one another together with a door track mounted in an upwardly and inwardly inclined position. Witn this construction, the upper and lower door sections are disposed in a common plane when the door is fully lowered, the common plane being inclined upwardly and inwardly to lie in a plane defined by the door track. The assembly also includes means associated with the bottom of the lower door section cooperating with the door track for guided movement of the door. With these features of construction, the weight of the door serves to assure that the door fully closes.

More specifically, the upwardly and inwardly inclined orientation of the door track provides a particularly advantageous result with the bi-fold door. The door, whether fully opened, fully lowered, or at some intermediate position, has a horizontal force component caused by the weight of the door which serves to stabilize the door in any position while assuring that the door completely closes and remains in a closed position when fully lowered. Because of this feature, the bi-fold door assembly has virtually no tendency to bind during operation, to stick in a partially opened position when fully lowered, or to flutter when fully lowered during gusty wind conditions.

Another unique feature of the present invention is the utilization of a bi-fold door assembly having an automatic opener operatively associated with the upper and lower door sections. The automatic opener includes a battery powered electrical motor and a battery which is operatively associated with a solar panel for recharging thereof. With this feature of construction, the bi-fold door assembly is well suited for use in remote regions having no supply of electricity.

In a preferred embodiment, the upper and lower door sections are hinged to one another by means of a double acting hinge to provide free relative movement of the upper and lower sections. The assembly then also preferably includes means for limiting pivotal movement of the lower door section to a single side of the plane defined by the upper door section where the limiting means comprises a bearing surface on the door track adapted to support the upper and lower door sections when fully lowered in the upwardly and inwardly inclined common plane previously described. The door track may be formed of steel angles having outwardly facing surfaces comprising bearing surfaces and defining straight sections associated with opposing ends of the upper and lower door sections.

Additionally, the top of the upper door section is preferably hinged for pivotal movement closely adjacent the top of the door track. The upper door section is then adapted for pivotal movement in a single direction opposite the direction of pivotal movement of the lower door section. More specifically, the top of the upper door section and bottom of the lower door section always remain in a plane defined by the door track. The lower door section includes guide rollers and column followers mounted on opposite ends at the bottom thereof for movement along the door tracks, With this arrangement, the upper and lower door sections are moveable between positions in which they lie in a common plane when fully closed and lie in a canopy position when fully opened.

With these features of construction, the bi-fold door assembly of the present invention accomplishes the objects defined hereinabove.

BRIEF DESCRIPTION OF THE DRAWINGS

In the drawings:

FIG. 1 is perspective view of a bi-fold door assembly for a building in accordance with the present invention;

FIG. 2 is a perspective view of a portion of the frame with the sheeting removed and the frame in a fully opened position taken along the right hand side of the bi-fold door assembly of FIG. 1;

FIG. 2A is an enlarged top plan view, in detail, illustrating a guide roller and column follower taken along the right hand side of the lower most portion of the frame in FIG. 2;

FIG. 2B is an enlarged perspective view, in detail, illustrating a device for initiating the opening movement of the door with the frame in a fully closed position taken along the right hand side of the bi-fold door assembly of FIG. 1;

DETAILED DESCRIPTION OF THE PREFERRED EMBODIMENTS

Figure 6:
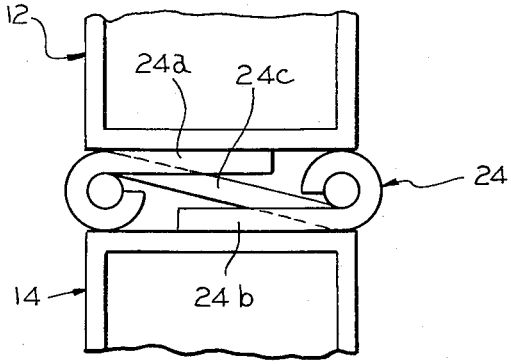
Figure 7:
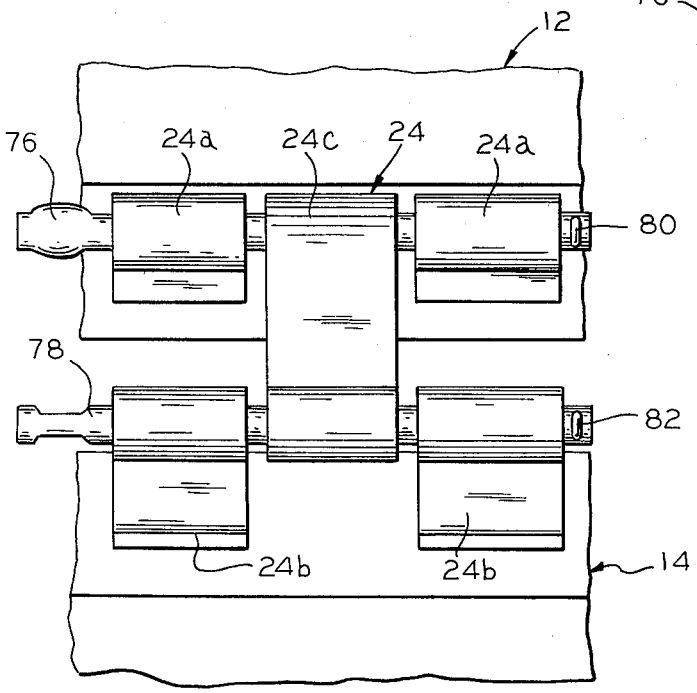
Figure 8:
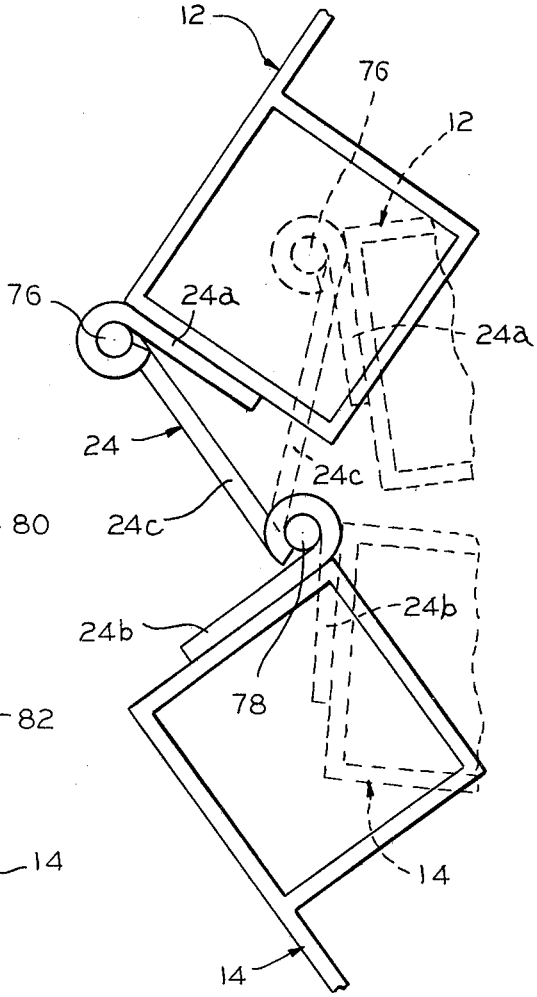

Referring to the drawings, and first to FIG. 1, the reference numeral 10 designated generally a bi-fold door assembly for a building in accordance with teh present invention. The bi-fold door assembly 10 includes an upper door section 12 and a lower door section 14, the door sections having front surfaces facing outwardly of the building and rear surfaces facing inwardly thereof, the upper door section 12 and the lower door section 14 being hinged to one another as at 16 (see also FIG. 6). A door track 18 which is suitably an angle iron bolted to the frame of the building, is also provided and is mounted adjacent the inwardly facing rear surfaces of the door sections in an upwardly and rearwardly, i.e., inwardly, inclined position relative to the building (see FIGS. 2 and 2A). The bi-fold door assembly further includes means such as a guide roller 20 and column follower 21 associated with the bottom of the lower door section 14 cooperating with the door track 18 (see particularly FIG. 2A). With these features of construction, the bi-fold door assembly 10 overcomes the problems and accomplishes the objectives set forth in detail hereinabove.

As will be appreciated, the upper and lower door sections 12 and 14 are disposed in a common plane when fully lowered. It will be seen by referring to the vertical frame members 22 and 23 in FIGS. 1 and 2 that the common plane defined by the fully lowered door sections 12 and 14 is slightly inclined upwardly and rearwardly to the plane defined by the frame members, i.e., inwardly relative to the building, the fully lowered door sections 12 and 14 lying in a plane defined by the two door track sections (such as 18) on opposite sides of the opening in the building. Also as suggested in FIG. 2, the upper and lower door sections 12 and 14 are disposed in a canopy position when fully opened.

Referring to FIGS. 5 through 8, it will seen that the upper and lower door sections 12 and 14 are hinged to one another by means of a double acting hinge 24. The double acting hinge 24 permits the lower door section 14 to pivot to either side of a plane defined by the upper door section 12, i.e., the upper and lower door sections 12 and 14, when so hinged without stops or other movement limiting structure, are free to pivot relative to one another throughout substantially 360 degrees. However, as will be appreciated, the bi-fold door assembly 10 includes means for limiting pivotal movement of the lower door section 14 to a single side of the plane defined by the upper door section 12.

Referring now to FIGS. 2 and 2A, the limiting means includes a bearing surface 26 on the door track 18. It will be appreciated that the bearing surface 26 is provided on each of the door track sections 18 and that it faces outwardly in confronting relationship to support the upper and lower door sections 12 and 14 when fully lowered. Moreover, as can be seen, the door track 18 is formed of steel angle with the outwardly facing surface comprising the bearing surface 26.

Still referring to FIGS. 2 and 2A, the door track 18 includes straight sections each of which is associated with opposing ends of the upper and lower door sections 12 and 14. The top of the upper door section 12 is then preferably hinged for pivotal movement adjacent the top of the door track 18 as at 28 in a single direction opposite the direction of pivotal movement of the lower door section 14. With guide rollers 20 and column followers 21 engaged with the door track 18, the top of the upper door section 12 and the bottom of the lower door section 14 always remain in a plane substantially defined by the door track 18.

As will be appreciated, the guide rollers 20 and the column followers 21 are engaged with the door track 18 for movement therealong, which can be accomplished in the fashion illustrated, by utilizing pins **20*a* and arms 21*a* joined to the horizontal frame member 25. Morover, as previously mentioned, the guide rollers 20 and column followers 21 will be mounted on opposite sides at the bottom of the lower door section 14 to accommodate the desired movement of the bi-fold door assembly 10** and between a fully lowered and a fully raised position.

As will also be appreciated, the guide rollers 20 and the column followers 21 are mounted on opposite sides at the bottom of the lower door section 14 in a manner accommodating one of the unique features of the present invention. Specifically, they are mounted such that the upper and lower door sections 12 and 14 rest against the bearing surfaces 26 on each of the straight sections at opposite ends of the door comprising the door track 18 when the door is fully lowered. As shown in detail in FIG. 2A, it will be appreciated that this is accomplished by locating the guide rollers 20 in the proper position relative to the inside of the lower door section 14.

With this arrangement, the upper and lower door sections 12 and 14 are sized to lie against the door track 18. Since the straight sections comprising door track 18 are inclined upwardly and rearwardly, the weight of the upper and lower door track sections 12 and 14 include a large force component directed along the door track 18 (generally vertical) and also includes a smaller force component extending generally perpendicular to the plane defined by the door track 18 (generally horizontal). By reason of these force components, the bi-fold door assembly 10 successfully achieves the objective of assuring that the upper and lower door sections 12 and 14 operate in the intended fashion at all times.

In particular, the generally vertical force component serves to assure that the upper and lower door sections 12 and 14 can be fully lowered at desired times. It will then be appreciated that the generally horizontal force component assures that the upper and lower door sections 12 and 14 will remain in contact with the bearing surfaces 26 on each of the straight sections comprising the door track 18 thereby assuring that the upper and lower door sections 12 and 14 will remain in fully lowered position until such time as it is desired to raise the door. In contrast to vertical hanging of doors, the generally horizontal force component serves to counteract any tendency of the bi-fold door assembly 10 to partially open in gusty wind conditions and the like.

Referring to FIG. 2, the magnitude of the force components can easily be varied as desired. It will be appreciated that this can be accomplished by varying the angle the door track 18 (and thus the upper and lower door sections 12 and 14 in a fully lowered position) make with the vertical as presented by the vertical frame member 22. By increasing the angle, the generally horizontal force component can be increased although with a commensurate decrease in the generally vertical force component.

Figure 3:
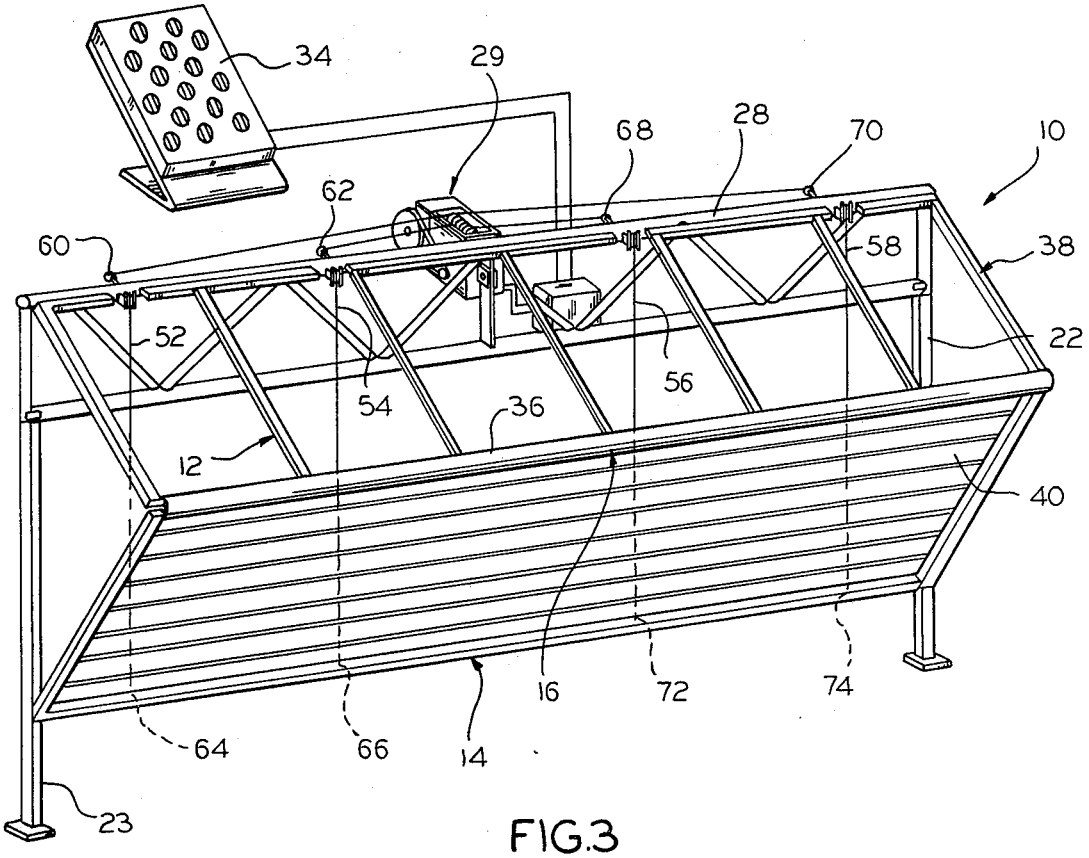
FIG. 3 is a perspective view similar to FIG. 1, with portions removed, for clarity in illustrating the invention.

Referring now to FIG. 3, the upper and lower door sections 12 and 14 can advantageously be raised and lowered by means of an automatic opener 29. The automatic opener 29, particularly in remote regions, can be electrically operated by means of an electrical motor 30 powered by a battery 32 (see FIG. 4). Because of the ease of operation of the bi-fold door assembly 10, the battery powered electrical motor 30 is fully adequate and the battery 32 can be operatively associated with a solar panel 34 for recharging thereof.

While the applications for the bi-fold door assembly are wide ranging, one particularly advantageous application is for use with aircraft hangars. The unique nature of aircraft hangars are ideally suited for utilization of the bi-fold door assembly of the present invention which similarly accommodates the objective of providing a device well suited for use in remote regions or in regions where electrical supply is not readily available or in regions with severe climatic conditions that require extra precautions against weather damage and the like to the contents of a building. However, as will be appreciated, the bi-fold door assembly of the present invention can successfully be utilized with a multitude of structures.

Referring to FIG. 1, the joint where the upper and lower door sections 12 and 14 are hinged to one another as at 16 is preferably covered with a flexible weather stripping 36. This serves to render the bi-fold door assembly 10 more weathertight and also serves to protect the double acting hinge 24 from the weather which could possibly cause rusting and consequent difficult operation. Of course, the bi-fold door assembly 10 can further be provided with other weather stripping to render it more weathertight in conventional fashion.

Referring to FIGS. 2 and 3, the upper and lower door sections 12 and 14 are preferably constructed of a tubular steel frame 38 covered with a sheet material 40. This type of construction, which includes structural members such as the vertical frame member 22, gives the structural integrity required of a door of substantial size and also is relatively easy to manufacture, ship and install at a relatively low cost while giving long years of effective use with a minimum of problems. While this construction has been illustrated, it will be appreciated that the features and advantages inherent in the bi-fold door assembly of the present invention are applicable and usable with other constructions as well.

Figure 4:
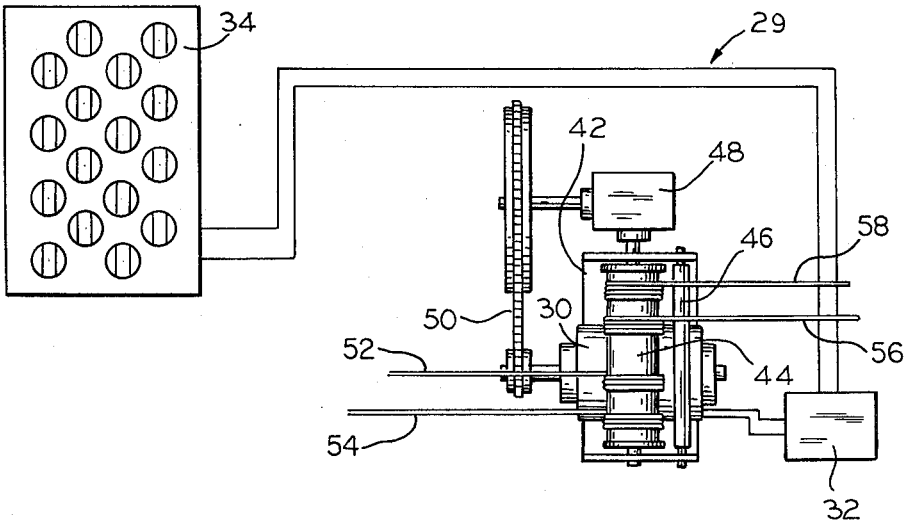
FIG. 4 is a plan view of an automatic opener assembly adapted for use with the bi-fold door assembly.
Figure 5:
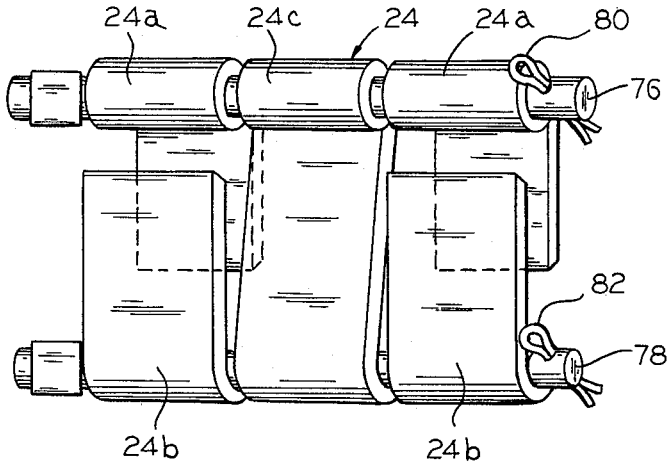
FIG. 5 through 8 are different views illustrating the construction and operation of a hinge in accordance with the present invention.

Referring to FIG. 4, the automatic opener 29 includes a support plate 42 upon which the electrical motor 30 is mounted. The support plate 42 also carries a take-up roller 44, a guide roller 46, and a gear box 48. With this arrangement, the electrical motor 30 drives the take-up roller 44 through a shaft and pulley mechanically secured to the motor which drives a drive belt 50 which, in turn, drives a shaft and pulley mechanically secured to the gearbox 48 which, in turn, drive the take-up roller 44 through another shaft, in conventional fashion.

As shown in FIGS. 3 and 4, a plurality of lift cables 52, 54, 56 and 58 are utilized. The lift cables 52 and 54 pass under the take-up roller 44, through pulley guide assemblies 60 and 62, and are attached at the bottom of the lower door section 14 as at 64 and 66 and the lift cables 56 and 58 pass over the take-up roller 44 and the guide roller 46, through the pulley guide assemblies 68 and 70, and are attached at the bottom of the lower door section 14 as at 72 and 74. With this arrangement, the automatic opener 28 can easily and effectively raise and lower the bi-fold door assembly 10.

As shown in FIG. 2B, it is advantageous to provide the bi-fold door assembly with a device for initiating the opening movement of the door This device 75, which may conveniently be referred to as a "door popper", holds one of the lift cables (such as 54 or 56) inwardly away from the tubular steel frame 38 so that as the door begins to open, the lift cable exerts not only a lifting force, but also a generally horizontally outward force substantially at the hinge point 16. As a result, the upper and lower door sections 12 and 14 open outwardly (as shown in FIGS. 1, 2 and 3) without any tendency to bind.

Referring to FIG. 2B in some detail, the door popper 75 preferably includes a cable support **75*a* pivotally secured to a mounting bracket 75*b* attached to one of the tubular support members of the frame 38. It will also be seen that a plate may be provided beneath the door popper 75 in line with the cable being carried thereby, and it will also be appreciated that it is highly advantageous to provide a door popper for each cable utilized (such as 52, 54, 56 and 58**), although it may be possible in certain instances to provide a door popper in association with a lesser number of cables than the total number actually being used for a particular bi-fold door assembly. With the construction illustrated in the drawings, a highly effective device for initiating the opening of a door has been provided.

Referring to FIGS. 5 through 8, a double acting hinge 24 is illustrated in some detail, and includes independent leaves **24*a* and 24*b* and common leaf 24*c*, all of which are held together by means of hinge pins 76 and 78 together with cotter keys 80 and 82. As shown, the leaves 24*a* are secured to the frame of the upper door section 12 and the leaves 24*b* are secured to the frame of the lower door section 14, both of which may be secured to their respective frames by a common means such as welding or the like. Also, while only a single double acting hinge 24** has been described herein, it will be appreciated by those skilled in the art that, in practice, a plurality of such hinges will be used.

Various changes coming within the spirit of the present invention may suggest themselves to those skilled in the art. Hence, it will be understood that the invention is not to be limited to the specific embodiments shown and described or the uses mentioned. On the contrary, the specific embodiments and uses are intended to be merely exemplary with the present invention being limited only by the true spirit and scope of the appended claims.

We claim:

1. A bi-fold door assembly for a building, comprising:

an upper door section and a lower door section hinged to one another, said door sections having front surfaces facing outwardly of said building and rear surfaces facing inwardly thereof;

a door track mounted adjacent said inwardly facing rear surfaces of said upper and lower door sections in an upwardly and inwardly inclined position relative to said building;

means associated with the bottom of said lower door section cooperating with said door track;

said upper and lower door sections being disposed in a common plane when fully lowered;

said common plane being inclined upwardly and inwardly relative to said building to lie in a plane defined by said door track; and a bearing surface on said door track adapted to support said upper and lower door sections when fully lowered.

2. The bi-fold door assembly of claim 1 in which said upper and lower door sections are disposed in a canopy position when fully opened.

3. The bi-fold door assembly of claim 1 in which said upper and lower door sections are hinged to one another by means of a double acting hinge.

4. The bi-fold door assembly of claim 3 including means for limiting pivotal movement of said lower door section to a single side of said plane defined by said upper door section.

5. The bi-fold door assembly of claim 4 in which said limiting means includes said bearing surface on said door track.

6. The bi-fold door assembly of claim 5 in which said door track is formed of steel angle, said steel angle including an outwardly facing surface, said outwardly facing surface comprising said bearing surface.

7. The bi-fold door assembly of claim 6 in which said door track includes straight sections associated with opposing ends of said upper and lower door sections, said straight sections both being formed of steel angles with outwardly facing surfaces.

8. The bi-fold door assembly of claim 7 in which the top of said upper door section is adapted to be hinged for pivotal movement above the top of said straight door track section, said upper door section being adapted for pivotal movement in a single direction opposite the direction of pivotal movement of said lower door section.

9. The bi-fold door assembly of claim 8 in which the top of said upper door section and the bottom of said lower door section always remain in a plane defined by said straight door track sections, said upper and lower door sections being disposed in a common plane when fully closed.

10. The bi-fold door assembly of claim 8 in which the top of said upper door section and the bottom of said lower door section always remain in a plane defined by said door track, said upper and lower door sections being disposed in a canopy position when fully opened.

11. The bi-fold door assembly of claim 1 in which said means cooperating with said door track comprises a guide roller and a column follower, said guide roller and said column follower engaging said door track for movement therealong, said guide roller and said column follower being mounted on the bottom of said lower door section.

12. The bi-fold door assembly of claim 1 in which said upper and lower door sections are raised and lowered by means of an automatic opener, said automatic opener being electrically operated by means of a battery powered electrical motor and a battery, said battery being operatively associated with a solar panel for recharging thereof.

* * * * *